US009234327B2

(12) United States Patent
Oickle et al.

(10) Patent No.: US 9,234,327 B2
(45) Date of Patent: Jan. 12, 2016

(54) FRONT LOADER ARRANGEMENT WITH HOOK-SHAPED LOCKING BAR

(71) Applicant: Deere & Company, Moline, IL (US)

(72) Inventors: Jody A. Oickle, Fonthill (CA); Henry Friesen, Niagara Falls (CA); Radu T. Guja, Welland (CA)

(73) Assignee: DEERE & COMPANY, Moline, IL (US)

( * ) Notice: Subject to any disclaimer, the term of this patent is extended or adjusted under 35 U.S.C. 154(b) by 7 days.

(21) Appl. No.: 14/339,526

(22) Filed: Jul. 24, 2014

(65) Prior Publication Data

US 2015/0030425 A1 Jan. 29, 2015

(30) Foreign Application Priority Data

Jul. 25, 2013 (DE) ..... 10 2013 214 559

(51) Int. Cl.
*E02F 3/627* (2006.01)
*E02F 3/38* (2006.01)

(52) U.S. Cl.
CPC ..... *E02F 3/382* (2013.01); *E02F 3/6273* (2013.01)

(58) Field of Classification Search
CPC ..... E02F 3/6273; E02F 3/627
See application file for complete search history.

(56) References Cited

U.S. PATENT DOCUMENTS

| | | | | |
|---|---|---|---|---|
| 3,460,690 | A * | 8/1969 | Seifert | E02F 3/6273 414/697 |
| 7,168,907 | B2 * | 1/2007 | Lyons | E02F 3/6273 414/686 |
| 9,057,179 | B1 * | 6/2015 | Kubas | E02F 3/627 |
| 2005/0281659 | A1 * | 12/2005 | Friesen | E02F 3/6273 414/686 |
| 2006/0245899 | A1 | 11/2006 | Lyons et al. | |
| 2011/0262256 | A1 | 10/2011 | Griffiths et al. | |

FOREIGN PATENT DOCUMENTS

| | | | |
|---|---|---|---|
| DE | 202006007042 | U1 | 10/2006 |
| EP | 0161410 | B1 | 7/1987 |
| EP | 1593781 | | 9/2005 |
| EP | 2042660 | | 4/2009 |
| EP | 2042660 | A2 | 4/2009 |

OTHER PUBLICATIONS

European Search Report issued in counterpart application No. 14178038.7, dated Nov. 17, 2014 (7 pages).

* cited by examiner

*Primary Examiner* — Gerald McClain

(57) ABSTRACT

A front loader arrangement includes a bracket, a mounting mast mounted on upper and lower bearings of the bracket, a loader arm which is articulated to a first pivot pin on the mast, a loader support articulated to a second pivot pin on the mast, and a locking device for locking the mast to the bracket. The locking device is arranged on the loader support. The locking device includes a pivoting locking bar which is mounted on a third pivot pin on the loader support, a pre-tensioning device which pre-tensions the locking bar depending on its position relative to the loader support into an open or a closed position, and an adjusting device arranged on the mast which can be brought into engagement with the locking bar, by which the locking bar can be moved into the closed position.

5 Claims, 9 Drawing Sheets

FRONT LOADER ARRANGEMENT WITH HOOK-SHAPED LOCKING BAR

FIELD

The present disclosure relates to a front loader arrangement.

BACKGROUND

Front loader arrangements are known. They generally comprise a mounting bracket or a mounting frame which is mounted on both sides of a carrier vehicle, for example a tractor, and a front loader with a loader arm which may be mounted on the mounting bracket on both sides of the carrier vehicle via a mounting mast corresponding to the corresponding mounting bracket. The mounting takes place via bearings on the mounting bracket, on which the mounting mast is placed and to which it is connected in a lockable manner. For parking or stopping the front loader, parking supports or loader supports are generally provided thereon, the parking supports or loader supports, for example, being able to be extended and positioned by a pivoting mechanism such that the front loader is securely supported when parked. As the mounting and dismantling of the front loader may be associated with a very complex operation, proposals have been put forward by which the mounting and/or dismantling process of the front loader could be increasingly automated and thus simplified.

Such a front loader arrangement is disclosed, for example, in EP 1 593 781 A2. A front loader is disclosed for a tractor with a mounting bracket, loader arm and loader support, wherein the loader support is pivotably mounted on a mounting mast of the front loader and by the pivoting movement which the mounting mast performs during the mounting and/or dismantling of the front loader on the mounting bracket, the loader support is either pivoted in toward the loader arm or pivoted away from the loader arm. Moreover, a locking of the mounted front loader is provided at the free end of the loader support in the pivoted-in state by fixing the loader support to a front part of the vehicle chassis so that by the locking of the loader support a fixing of the mounting mast is also achieved relative to the mounting bracket. A drawback is that firstly the locking takes place at a point on the vehicle chassis remote from the driver's cab and thus, in particular, the unlocking process, inasmuch as it is not automatically carried out, is time-consuming and secondly it is difficult or impossible for the driver to see, in particular, whether the locking has been carried out correctly. Furthermore, the locking is only suitable for an angle between the loader support and the mounting mast which is determined in the parked position. Therefore, further adjustments to the mounting mast have to be undertaken if, for example when changing the front loader tool, the geometric relations are altered, in particular the angle between the loader support and the mounting mast. This is achieved in this case by a complicated adjusting device which is arranged between the loader support and the mounting mast.

A comparable front loader arrangement is disclosed in EP 2 042 660 A2. A similarly complicated locking solution is also used here with the cited drawbacks.

U.S. Pat. No. 7,168,907 B2 also discloses a front loader arrangement of the aforementioned type but with a locking device which is directly in engagement with the mounting bracket and/or directly locks the connection between the mounting mast and the mounting bracket. The loader support used here, in contrast to the aforementioned examples, is configured rigidly in the form of a tubular frame mounted on the mounting mast, the tubular frame being lowered to the ground as soon as the mounting mast is inclined to the front relative to the mounting bracket when dismantling the front loader. This solution may be suitable for smaller front loader models with small, compact and relatively short loader supports. For larger and heavier front loader arrangements, if only for statical reasons, greater support forces and thus more stable loader supports, optionally also with different carrier profile structures and larger dimensions, are required. However, this does not alter the fact that for an operating position and for a parked position, specific geometric arrangements have to be maintained on the front loader which is why a pivotable arrangement of the loader support is often desirable, if not imperative.

SUMMARY

It is desired to provide a front loader arrangement of this type mentioned in the introduction by which the aforementioned problems are overcome.

According to an aspect of the present disclosure, a front loader arrangement is provided which combines the advantages of locking the mounting mast to the mounting bracket with a loader support pivotably articulated to the mounting mast.

According to the invention, a front loader arrangement of the type mentioned in the introduction is configured such that the locking device is arranged on the loader support, the locking device comprises a pivoting locking bar which is mounted on a third pivot pin arranged on the loader support, a pre-tensioning device which pre-tensions the pivoting locking bar depending on its pivoted position relative to the loader support into an open position or into a closed position, and an adjusting device arranged on the mounting mast and able to be brought into engagement with the pivoting locking bar, by which the pivoting locking bar is able to be moved into its pre-tensioned closed position, by pivoting the loader support relative to the mounting mast, wherein by pivoting the mounting mast relative to the bracket about the lower bearing, the pivoting locking bar in its closed position is able to be brought into engagement with the upper bearing of the mounting bracket by pre-tensioning. By means of the front loader arrangement according to the invention, it is possible to lock the front loader to the bracket, so that an operator also has the option of observing that the locking has been carried out correctly from an operating platform or cab. Moreover, for a dismantling process and without having to take further measures, an operator is able to actuate the locking mechanism in his immediate vicinity and move the pivoting locking bar from the closed position into the open position, for example by means of foot actuation. Naturally, this may also be carried out by manual actuation. By the pivotable arrangement of the loader support on the mounting mast and the arrangement of the locking device on the loader support, the locking device is independent of a tool guided on the front loader, so that irrespective of an angle set between the loader support and the mounting mast in the parked position, no adjustments have to be carried out on the mounting mast, if for example the geometric relations are altered when changing the front loader tool. A complicated adjusting device, which is arranged between the loader support and the mounting mast, is dispensed with. Moreover, the loader support used here may be configured robustly and is pivotably fastened to the mounting mast, so that even heavier front loaders may be securely parked. By pre-tensioning the pivoting locking bar and arranging the pivoting locking bar on the loader support and arranging the adjusting device on the mounting mast, the locking element may be controlled solely by relative pivoting movements between the mounting mast and the loader support, resulting in options for coupling and locking the front loader arrangement which are partially automated and thus a more user-friendly operation of the entire front loader arrangement.

An actuator for lifting and lowering the loader arm is arranged between the loader support and the loader arm, wherein the actuator is pivotably connected to the loader support via a pivot pin. As a result, when the pivoting locking bar is open, the loader support may be pivoted by actuating the actuator, in particular when the mounting mast is lowered by the bracket, i.e. the front loader arrangement is moved into a parked position. The loader arm in this case is supported on the ground so that the actuator may pivot out the loader support. By the pivoted mounting of the loader support on the mounting mast, and the pivoted mounting of the mounting mast on the lower bearing, when opening the pivoting locking bar and actuating the actuator both the loader support may be pivoted relative to the mounting mast and the mounting mast may be pivoted about the lower bearing on the bracket.

By pivoting the loader support relative to the mounting mast, during a dismantling process the adjusting device is able to be brought into engagement with the pivoting locking bar and the pivoting locking bar is able to be moved from a pre-tensioned open position into a pre-tensioned closed position. After the pivoting locking bar has been opened, which for a dismantling process has been moved from its pre-tensioned closed position into its opened position (open position), the locking of the mounting mast on the bracket is released so that the mounting mast is pivoted relative to the bracket about the lower bearing, as soon as the actuator is actuated. At the same time, the loader support is also pivoted relative to the mounting mast, so that a relative pivoting movement between the loader support and the mounting mast results. In this case, the adjusting device is guided toward the pivoting locking bar so that the pivoting locking bar is moved into a pivoted position relative to the loader support and the pivoting locking bar is moved from its pre-tensioned open position again into its pre-tensioned closed position.

The adjusting device comprises an adjusting pin arranged on the mounting mast parallel to the third pivot pin. The adjusting pin extends from the mounting mast through a first arcuate slot configured on the loader support. The third pivot pin extends in this case through a second arcuate slot configured on the mounting mast, so that the loader support is only pivotable relative to the mounting mast in the region of a pivot angle limited by the first and second arcuate slots. Such an arrangement permits a pivoting of the mounting mast to be able to take place relative to the bracket by actuating the actuator and/or by pivoting out the loader support, so that the mounting mast and the loader support may be pivoted together such that initially the loader support is increasingly pivoted toward the ground and at the same time the mounting mast is also inclined to the front, until finally the mounting mast is released from the lower bearing and lifted. The front loader arrangement is now located in the parked position in which it is firstly supported on a front end of the loader arm or a front loader tool located thereon and secondly on the loader support.

The pivoting locking bar has a hook-shaped design which is able to be brought into engagement with the upper bearing. In particular, the pivoting locking bar is shaped such that it at least partially positively surrounds the upper bearing configured by a cylindrical bolt pin. In this case it is also conceivable to provide a bolt pin of square cross section as the upper bearing, so that the pivoting locking bar may have a hook shape which is instead of angular configuration.

The pre-tensioning device comprises a tensioning element which at one end is connected to a lever arm configured on the pivoting locking bar and at the other end is connected to the loader support, wherein the connecting point on the lever arm is arranged between the connecting point on the loader support and the third pivot pin. As a result, it may be ensured that depending on the pivoted position of the pivoting locking bar a pre-tensioning may be carried out clockwise about the third pivot pin or counterclockwise. The lever arm, the pivoting locking bar, the third pivot pin, the upper bearing and the adjusting pin are configured and aligned relative to one another such that the pivoting locking bar is pre-tensioned by the tensioning element in an open position, after the pivoting locking bar has released the upper bearing and is pre-tensioned into a closed position, after the pivoting locking bar been brought into engagement with the adjusting pin. The tensioning element may be configured, for example, by a torsion spring.

DETAILED DESCRIPTION OF THE DRAWINGS

A front loader arrangement 10 is generally used on tractors, towing vehicles or similar agricultural vehicles of smaller construction. Such a front loader arrangement 10, however, may also be used in larger agricultural vehicles or even in construction machines. The remainder of the description is limited to showing components of the front loader arrangement 10 which are located on the front right-hand side of a tractor or the like and/or fastened there when the front loader arrangement 10 is mounted. Such an arrangement of components on the left-hand side of a tractor is correspondingly implemented in a laterally reversed construction and also forms part of the front loader arrangement 10 shown here. Directional information used hereinafter refers to the longitudinal direction of a tractor and/or to the longitudinal direction of a front loader arrangement 10 mounted on the tractor, wherein the front loader arrangement 10 is able to be mounted on the side of the tractor located at the front in the longitudinal direction and extends in the forward travel direction of the tractor.

Figure 1:
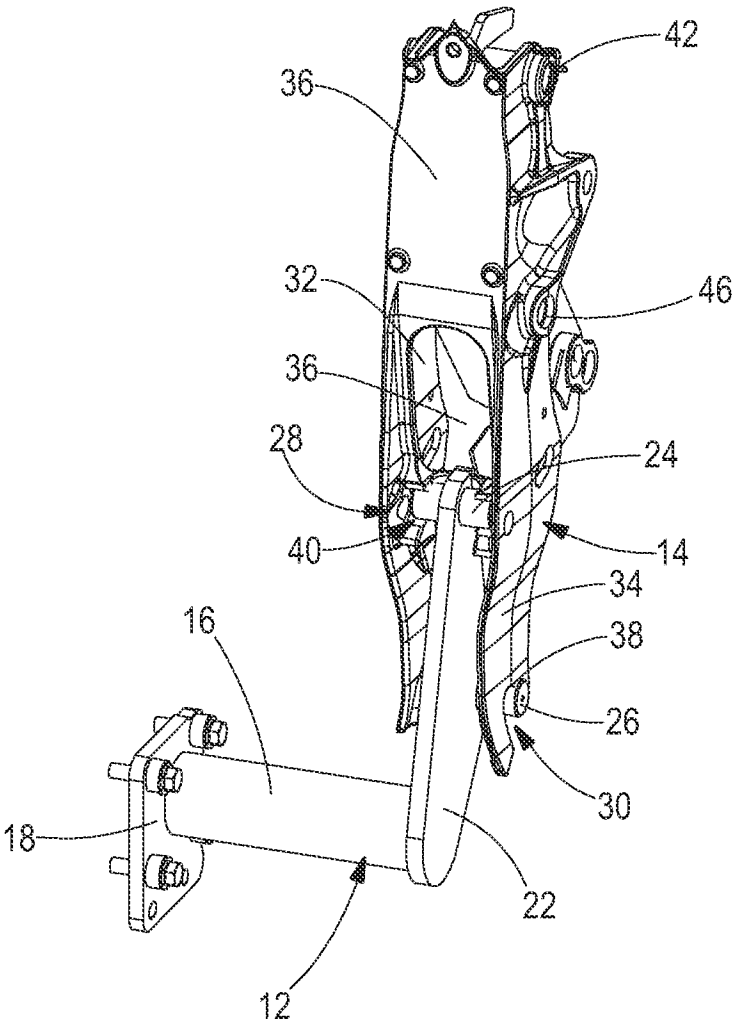
FIG. 1 is a perspective side view of a bracket with a mounting mast of a front loader arrangement according to the invention.

FIG. 1 shows a bracket 12 and a mounting mast 14 of the aforementioned front loader arrangement 10. The bracket 12 comprises a support tube 16 which extends transversely to the side of a tractor and which is mounted on the chassis 20 of a tractor (not shown) via a connecting flange 18, as well as a connecting plate 22 extending vertically from the support tube 16. Upper and lower bearing pins 24, 26 or bearing bushes extending transversely are configured on the connecting plate 22, the bearing pins or bearing bushes forming a part on the bracket side of an upper bearing 28 and a lower bearing 30. The mounting mast 14 comprises an inner mounting plate and an outer mounting plate 32, 34 which are arranged parallel to one another and extend vertically above the lower bearing 30. The mounting plates 32, 34 are connected together at a distance from one another via a plurality of transversely extending connecting webs 36. In each case recesses 38 are formed at the lower ends of the mounting plates 32, 34, the recesses forming the part on the mounting mast side of the lower bearing 30 and serve as a bearing seat or receiver for the lower bearing pin 26. Above the recesses 38, in each case bearing pockets 40 are formed on the inside of the mounting plates 32, 34, the bearing pockets forming the part on the mounting mast side of the upper bearing 28 and serve as a bearing seat or receiver for the upper bearing pin 24.

Figure 2:
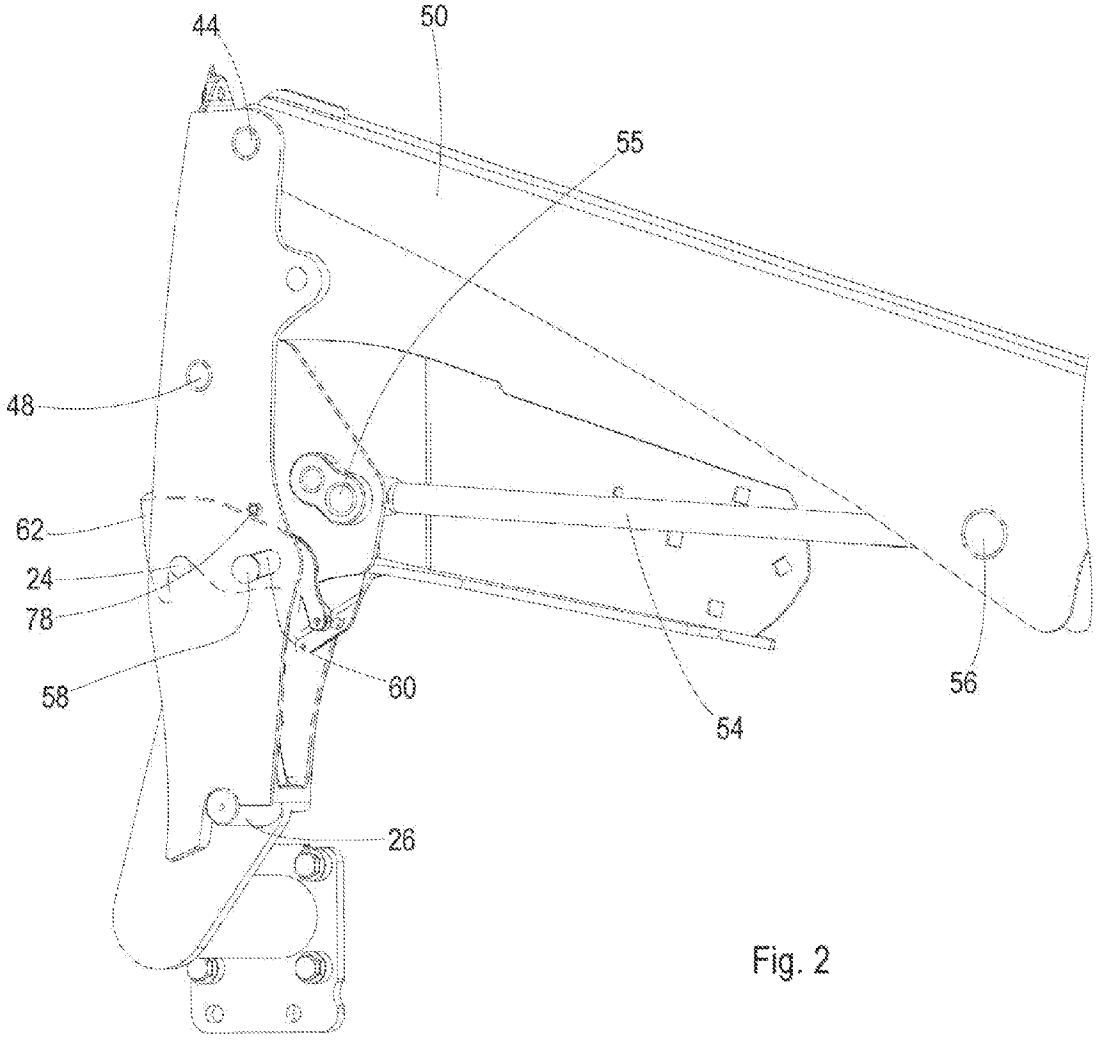
FIG. 2 is a perspective side view of the mounting mast with the loader arm and loader support articulated thereto.

As may be seen further in FIG. 1, bearing bushes 42 are formed at an upper end of the mounting plates 32, 34 for receiving a pivot pin 44 (see FIG. 2). Between the bearing bushes 42 and the bearing pockets 40, in a central region of the mounting plates 32, 34 above the bearing pockets 40 further bearing bushes 46 are formed for receiving a further pivot pin 48. Via the pivot pin 44 a loader arm 50 of the front loader arrangement 10 is pivotably fastened at its rear end to the mounting mast 14. Via the pivot pin 48 a loader support 52 of the front loader arrangement 10 is pivotably fastened at its rear upper end to the mounting mast 14.

Between the loader support 52 and the loader arm 50 extends an actuator 54 in the form of a hydraulic cylinder. The actuator 54 is also pivotably connected at one end via a pivot pin 55 to the loader support 52 and pivotably connected at the other end via a pivot pin 56 to the loader arm 50. By extending and retracting the actuator 54, therefore, a pivoting of the loader arm 50 relative to the loader support 52 may be permitted and thus the position of the loader support 52 may be varied relative to the loader arm 50.

At a rear lower end of the loader support 52 a further pivot pin 58 is arranged, the pivot pin being fastened fixedly to the loader support 52 and extending in the transverse direction through an arcuate slot 60, formed on the mounting mast 14 and the mounting plates. The arcuate slot 60 is configured such that it extends in an arcuate manner along a circular arc around the pivot pin 58. By the cooperation between the pivot pin 58 and the arcuate slot 60, therefore, a pivoting movement of the loader support 52 about the other pivot pin 48 of the loader support 52 is limited so that a pivoting of the loader support 52 relative to the mounting mast 14 is only permitted within the arcuate guidance of the pivot pin 58 within the slot 60.

Figure 3:
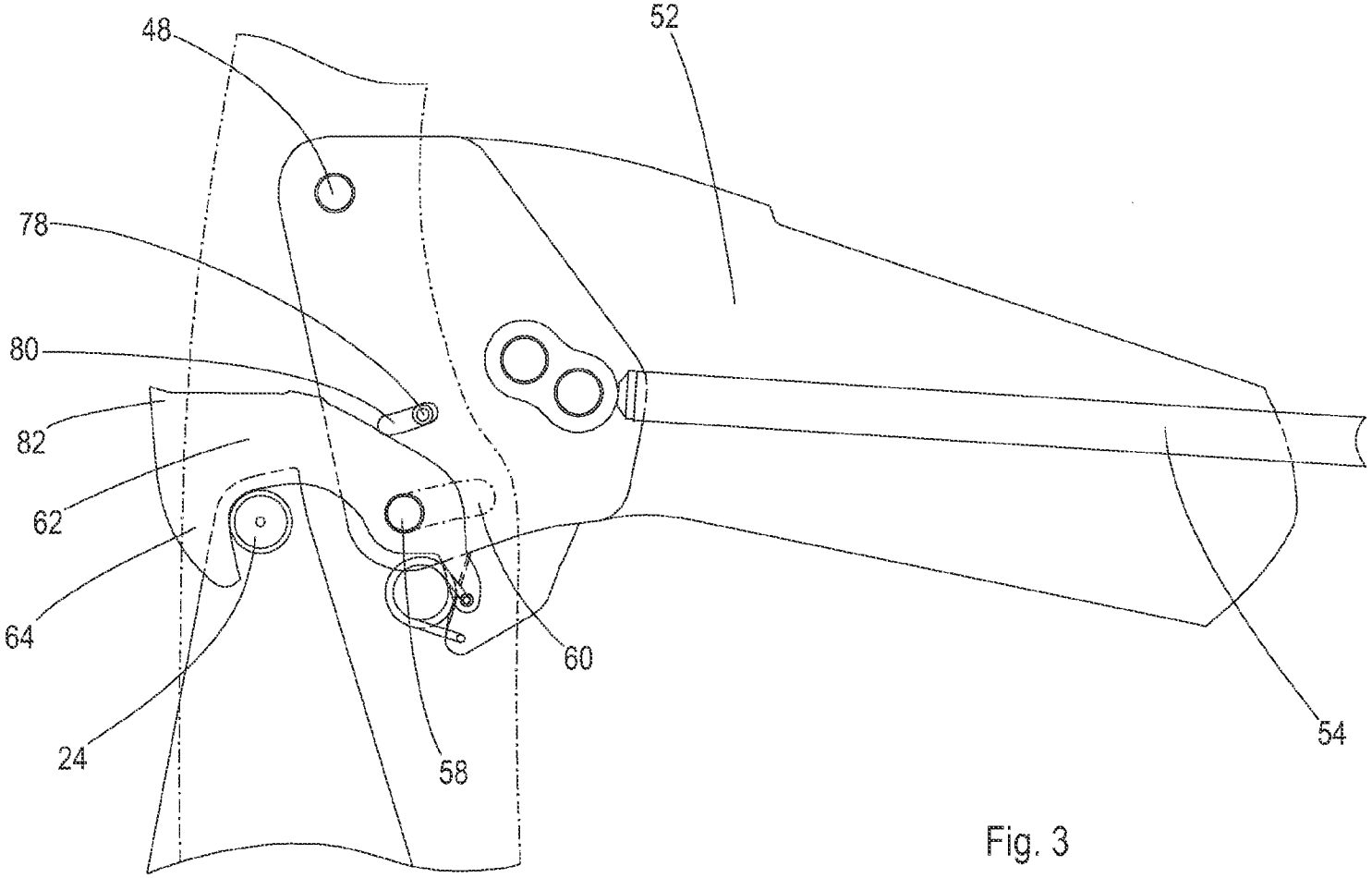
FIG. 3 is an enlarged side view of the mounting mast with the loader support, with the locking device arranged thereon in a pre-tensioned closed position when the front loader arrangement is mounted thereon.

Between the mounting plates 32, 34 a pivoting locking bar 62 is mounted on the pivot pin 58. The pivoting locking bar 62 has a hook-shaped design in the form of a hook-shaped gripping arm 64 which extends from the pivot pin 58 in the rearward and upward direction and/or when the front loader arrangement 10 is mounted it extends in the direction of the upper bearing pin 24 and encompasses the bearing pin in a closed position. Moreover, the pivoting locking bar 62 comprises a control arm 66 which extends from the pivot pin 58 and forms a lever arm about the pivot pin 58. The control arm 66 is connected via a tensioning element 68 in the form of a leg spring 70 to the loader support 52, wherein the leg spring 70 is respectively pivotably fastened with its first leg 72 at a connecting point 73 to the free end of the control arm 66 and with its other leg 74 at a connecting point 75 to the loader support 52. By altering the position of the connecting point 73 relative to the pivot pin 58 and the connecting point 75 the direction of the pre-tensioning force of the tensioning element 68 is altered. The pivoting locking bar 62 is accordingly pre-tensioned into the closed position, as soon as the connecting point 73 is located in front of an imaginary connecting line between the center of a circle 76 of the pivot pin 58 and the second connecting point 75 (see FIGS. 3 and 5). Otherwise, the pivoting locking bar 62 is pre-tensioned into the open position as soon as the connecting point 73 is located behind the aforementioned imaginary connecting line between the center of a circle 76 of the pivot pin 58 and the second connecting point 75 (see FIG. 4).

An adjusting device in the form of an adjusting pin 78 extending between the mounting plates 32, 34 is also formed on the mounting mast 14, the adjusting device being fastened fixedly to the mounting mast 14 above the pivot pin 58. The adjusting pin 78 extends in the transverse direction through the loader support 52. Arcuate slots 80 are incorporated in the loader support 52, through which the adjusting pin 78 extends, so that when pivoting the loader support 52 relative to the mounting mast 14 the adjusting pin 78 may move within the arcuate slots 80.

Figure 4:
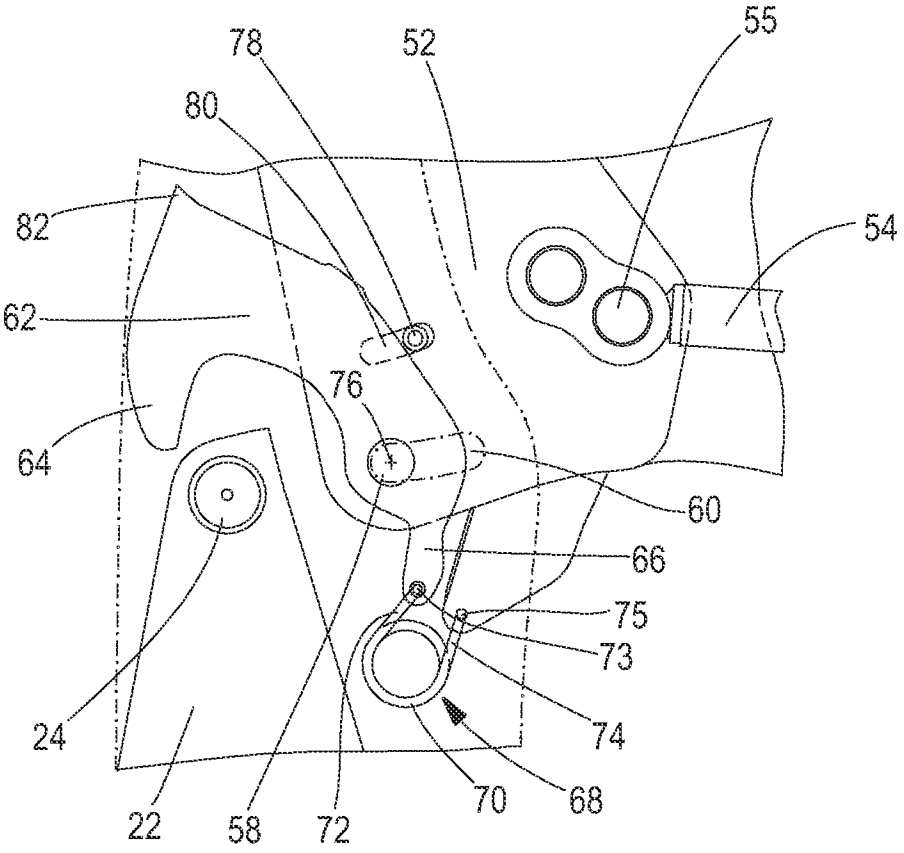
FIG. 4 is an enlarged side view of the locking device in a pre-tensioned open position when the front loader arrangement is mounted thereon.

For releasing the front loader arrangement 10 a projection 82 is provided on the upper face of the hook-shaped gripping arm 64 which serves as a gripping or actuating point in order to lever the pivoting locking bar 62 out of its closed position (see FIG. 3) into its open position (see FIG. 4). The actuation of the pivoting locking bar 62 may, for example, take place directly by manual actuation or by foot actuation. Actuation by an actuator, whether electrical or hydraulic, is also conceivable.

By actuating the pivoting locking bar 62, the locking bar is pivoted from its closed position (FIG. 3) into its open position (FIG. 4). In the open position, the front loader arrangement 10 may be released from the bracket 12 by the actuator 54 being extended and the mounting mast 14 being inclined to the front in a pivotable manner about the bearing pin 26. According to the arrangement of the loader support 52, the loader support moves downwards at the same time so that with increased extension of the actuator 54 firstly the angle of inclination of the mounting mast 14 is altered relative to the bracket 12 and secondly the position of the loader support 52 is altered relative to the loader arm 50, wherein the loader support 52 moves increasingly downwards in the direction of the ground contact surface.

Figure 5:
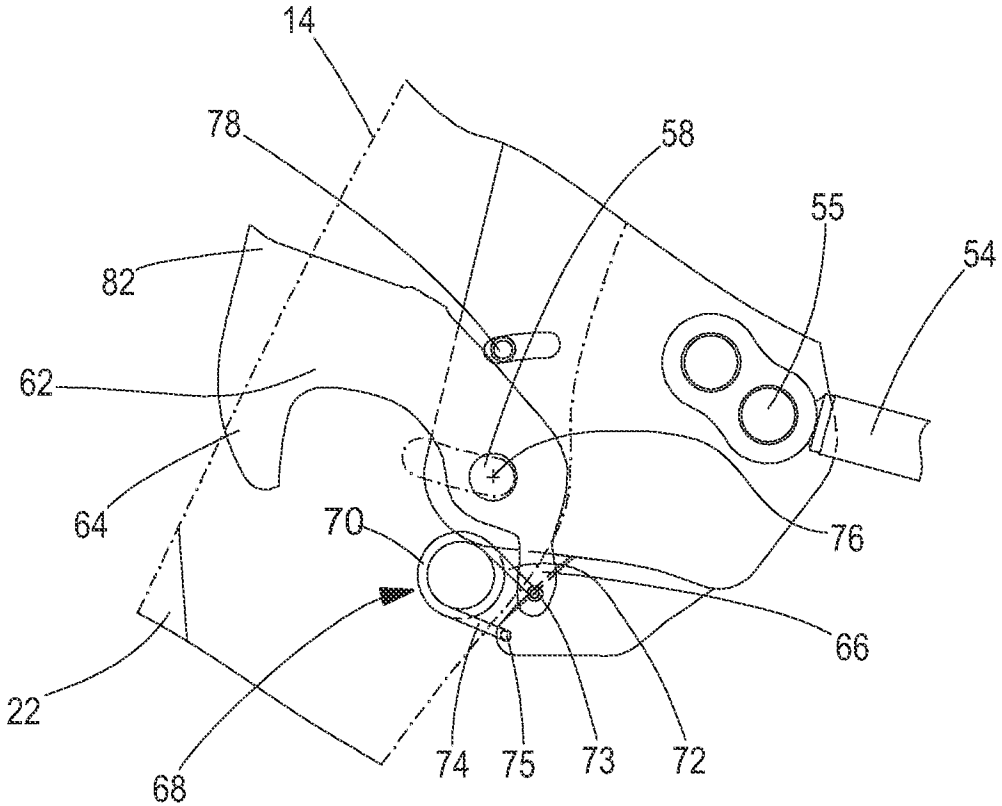
FIG. 5 is an enlarged side view of the locking device in a pre-tensioned closed position when the front loader arrangement is dismantled.

When pivoting the loader support 52 downwards, according to the arrangement of the adjusting pin 78, the pivoting locking bar 62 mounted on the pivot pin 58 moves toward the adjusting pin 78, until the pivoting locking bar 62 comes into engagement with the pivot pin 58 and the adjusting pin 78 arranged fixedly on the mounting mast 14, forces the pivoting locking bar 62 out of its pre-tensioned open position (see FIG. 4) into the pre-tensioned closed position (see FIG. 5).

Figure 6:
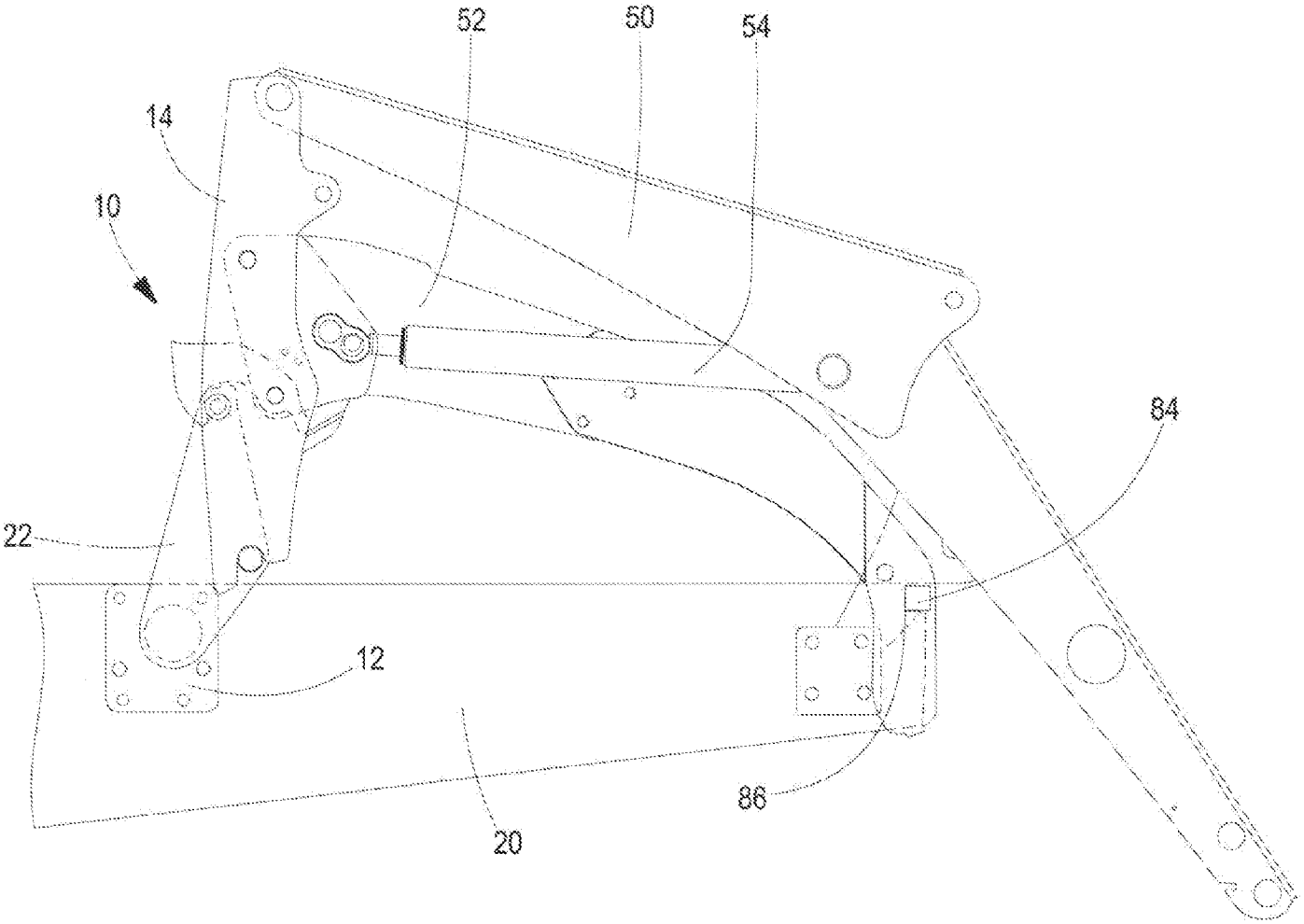
FIG. 6 is a side view of the front loader arrangement in the mounted state when the locking device is in a pre-tensioned closed position.
Figure 7:
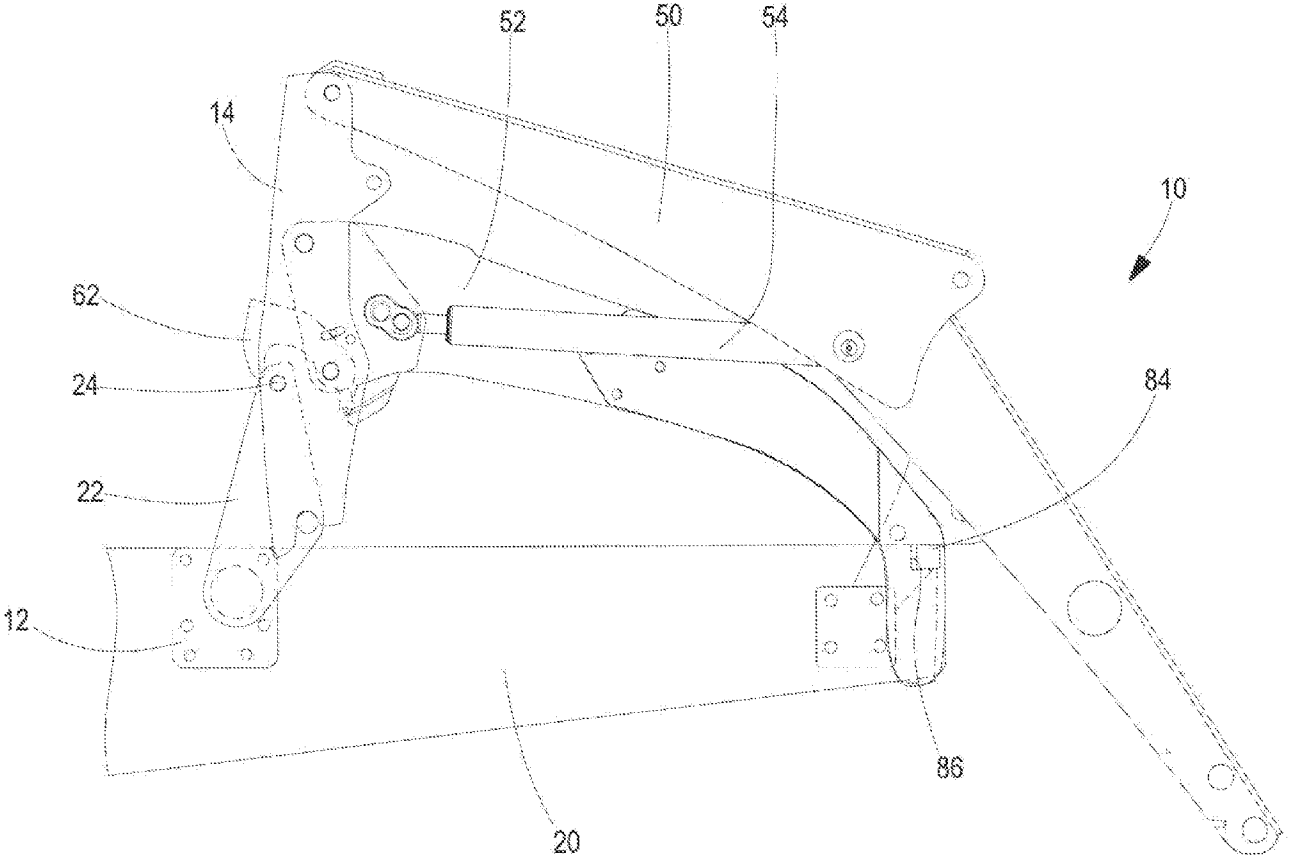
FIG. 7 is a side view of the front loader arrangement at the start of a dismantling process when the locking device is in a pre-tensioned open position.
Figure 8:
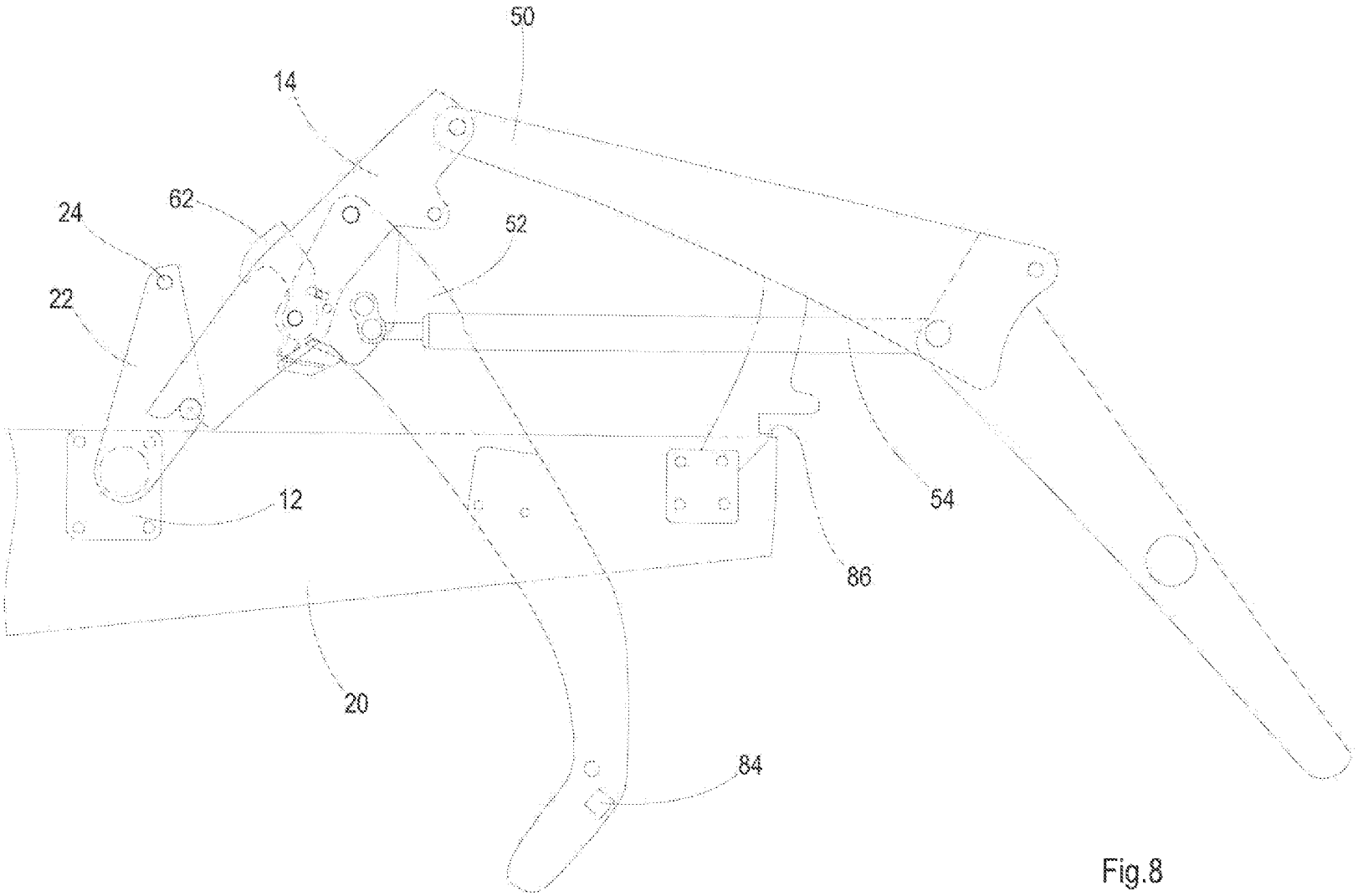
FIG. 8 is a side view of the front loader arrangement at the end of a dismantling process when the locking device is in a pre-tensioned closed position.

In the front region of the loader support 52 a transverse strut 84 is arranged by which, when the front loader arrangement 10 is mounted, the loader support 52 is retained on a receiver 86 formed on the front end of the chassis 20 (see FIG. 6). With the release of the front loader device 10 and the start of the pivoting forward of the mounting mast 14 (see FIG. 7) by extending the actuator 54, the loader support 52 is also moved slightly forward so that the transverse strut 84 is moved out of the receiver 86 and the loader support 52 is transferred into a downward movement and moves downward in the direction of the ground contact surface. With increased lowering of the loader support 52, the pivoting locking bar 62 also moves toward the adjusting pin 78 and is moved again thereby into a pre-tensioned closed position (see FIG. 8). The loader support 52 reaches the ground contact surface and supports the front loader arrangement 10 on the ground, so that the front loader arrangement is moved into a parked position. The mounting mast 14 in this case is adjusted by the loader support 52 such that the lower bearing pins 26 are released and the front loader arrangement 10 may be removed from the vehicle (towing vehicle, tractor).

Figure 9:
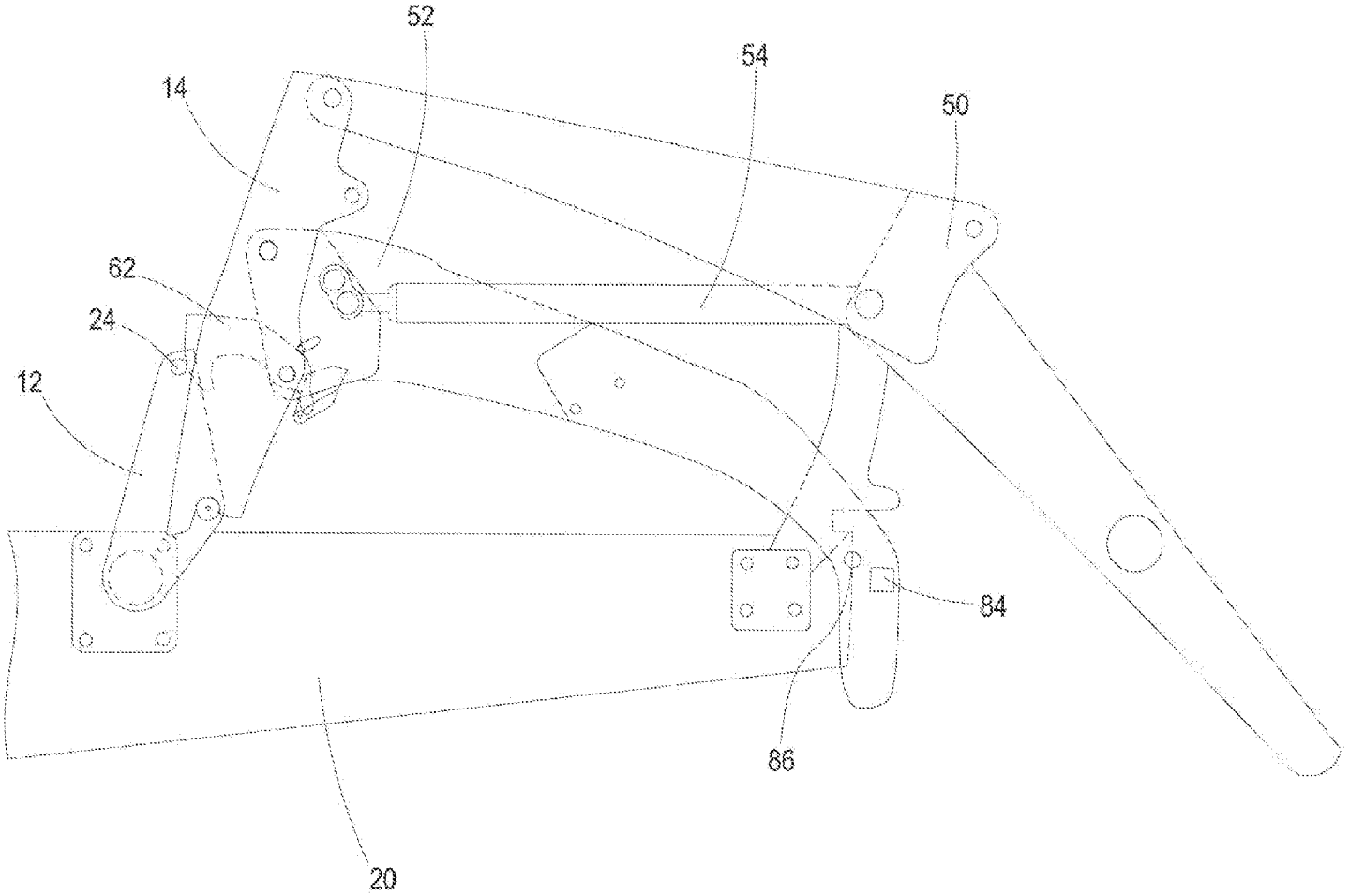
FIG. 9 is a side view of the front loader arrangement at the end of a mounting process when the locking device is in a pre-tensioned closed position.

The mounting of the front loader arrangement 10 takes place in reverse, i.e. the vehicle is moved onto the front loader arrangement 10 in the mounting position and the actuator 54 is retracted. The mounting mast 14 in this case is positioned on the lower bearing pin 26. With increased retraction of the actuator 54, the mounting mast 14 is increasingly pivoted in the direction of the upper bearing pin 24 wherein the pivoting locking bar 62, which is already in the pre-tensioned closed position, comes into engagement with the upper bearing pin 24 (see FIG. 9) and is raised thereby, until finally the hook-shaped gripping arm 64 encompasses the upper bearing pin 24 and locks the bearing pin and/or locks the front loader arrangement 10. At the same time, the loader support 52 is lifted (see FIG. 9) and moved into the receiver 86 on the chassis 20 of the vehicle.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A front loader arrangement having a bracket, a mounting mast mountable on an upper bearing and on a lower bearing of the bracket, a loader arm which is articulated to a first pivot pin arranged on the mounting mast, a loader support articulated to a second pivot pin arranged on the mounting mast, and a locking device for locking the mounting mast to the bracket, characterized in that:

the locking device is arranged on the loader support, said locking device comprises:

a pivoting locking bar which is mounted on a third pivot pin arranged on the loader support;

a pre-tensioning device which pre-tensions the locking bar depending on its pivoted position relative to the loader support into an open position or into a closed position; and an adjusting device arranged on the mounting mast and is engagable with the locking bar, by which the locking bar can be moved into the pre-tensioned closed position, wherein by pivoting the mast relative to the bracket about the lower bearing, the locking bar in its closed position can be brought into engagement with the upper bearing of the bracket by pre-tensioning wherein the mounting mast downwardly engages a lower bearing pin; and wherein the locking bar is hook-shaped and is downwardly engagable with the upper bearing.

2. The front loader arrangement of claim 1, wherein:

an actuator for lifting and lowering the loader arm is arranged between the loader support and the loader arm, wherein the actuator is pivotably connected to the loader support via a pivot pin.

3. The front loader arrangement of claim 1, wherein:

by pivoting the loader support relative to the mounting mast during a dismantling process the adjusting device can be brought into engagement with the locking bar and the locking bar can be moved from a pre-tensioned open position into a pre-tensioned closed position.

4. The front loader arrangement of claim 1, wherein:

the adjusting device comprises an adjusting pin arranged on the mounting mast parallel to the third pivot pin, said adjusting pin extending from the mounting mast through a first arcuate slot formed on the loader support, and the third pivot pin extends through a second arcuate slot formed on the mounting mast, so that the loader support pivots relative to the mounting mast in the region of a pivot angle limited by the first and second arcuate slots.

5. The front loader arrangement of claim 1, wherein:

the pre-tensioning device comprises a tensioning element having a first end connected to a lever arm formed on the locking bar and a second end connected to the loader support, wherein a connecting point on the lever arm is arranged between a connecting point on the loader support and the third pivot pin.

* * * * *